US006045682A

United States Patent [19]

Rodriguez

[11] Patent Number: 6,045,682

[45] Date of Patent: Apr. 4, 2000

[54] DUCTILITY AGENTS FOR NICKEL-TUNGSTEN ALLOYS

[75] Inventor: Danielle Rodriguez, Clinton Township, Mich.

[73] Assignee: Enthone-OMI, Inc., Warren, Mich.

[21] Appl. No.: 09/046,869

[22] Filed: Mar. 24, 1998

[51] Int. Cl.[7] ..... C25D 3/56

[52] U.S. Cl. ..... 205/238; 205/255; 205/259; 205/260; 106/1.24; 106/1.25

[58] Field of Search ..... 205/238, 255, 205/259, 260; 106/1.25, 1.24

[56] References Cited

U.S. PATENT DOCUMENTS

| | | | |
|---|---|---|---|
| H001184 | 5/1993 | Batra et al. | 420/3 |
| 2,191,813 | 2/1940 | Brown | 204/14 |
| 2,402,801 | 6/1946 | Brown | 204/49 |
| 2,466,677 | 4/1949 | Brown | 204/49 |
| 2,513,280 | 7/1950 | Brown | 204/49 |
| 2,523,190 | 9/1950 | Brown | 204/49 |
| 2,523,191 | 9/1950 | Brown | 204/49 |
| 2,781,305 | 2/1957 | Brown | 204/49 |
| 2,852,449 | 9/1958 | Becking et al. | 204/49 |
| 2,882,208 | 4/1959 | Becking et al. | 204/49 |
| 3,090,733 | 5/1963 | Brown | 204/40 |
| 3,220,940 | 11/1965 | Brown et al. | 204/49 |
| 3,264,200 | 8/1966 | Clauss et al. | 204/49 |
| 3,268,307 | 8/1966 | Tomaszewski et al. | 29/194 |
| 3,268,308 | 8/1966 | Tomaszewski et al. | 29/194 |
| 3,563,866 | 2/1971 | Clauss et al. | 204/49 |
| 3,637,422 | 1/1972 | Landingham et al. | 75/176 |
| 3,639,220 | 2/1972 | Fuchs et al. | 204/49 |
| 3,703,448 | 11/1972 | Clauss et al. | 204/40 |
| 3,719,854 | 3/1973 | Sedlatschek et al. | 313/330 |
| 3,802,851 | 4/1974 | Dunham | 75/207 |
| 3,806,429 | 4/1974 | Clauss et al. | 204/41 |
| 3,876,513 | 4/1975 | Brown et al. | 204/48 |
| 3,927,989 | 12/1975 | Koo | 75/205 |
| 4,384,929 | 5/1983 | Tremmel et al. | 204/40 |
| 4,427,445 | 1/1984 | Holzl et al. | 75/234 |
| 4,525,248 | 6/1985 | Landa et al. | 205/260 |
| 4,549,942 | 10/1985 | Tremmel et al. | 204/40 |
| 4,597,789 | 7/1986 | Reese | 65/106 |
| 4,605,599 | 8/1986 | Penrice et al. | 428/665 |
| 4,670,216 | 6/1987 | Patrician et al. | 419/15 |
| 4,784,690 | 11/1988 | Mullendore | 75/248 |
| 4,786,468 | 11/1988 | Wang et al. | 420/427 |
| 4,839,237 | 6/1989 | Coulon et al. | 428/610 |
| 4,885,028 | 12/1989 | Kopatz et al. | 75/0.5 BB |
| 4,913,731 | 4/1990 | Kopatz et al. | 75/346 |
| 5,069,869 | 12/1991 | Nicolas et al. | 419/28 |
| 5,108,542 | 4/1992 | Lin | 156/643 |
| 5,258,884 | 11/1993 | Howard et al. | 360/113 |
| 5,415,763 | 5/1995 | Johnson et al. | 205/287 |
| 5,525,206 | 6/1996 | Wieczerniak et al. | 205/238 |

OTHER PUBLICATIONS

Chemical Abstract 1980: 415726, no month.

Chemical Abstract 1994: 520250, no month.

*Journal of the Electrochemical Society*, vol. 107, No. 1–12, Jan.–Dec. 1960, "Effect of Addition Agents on Tungsten Codeposition" (pp. 277–280).

*Modern Electroplating*, Second Edition, "Cobalt and Cobalt Alloys" (p. 145), no date available.

*Electrodeposition of Alloys, Principles and Practice*, by Abner Brenner, vol. I, 1963 (p. 358), no month available.

*Electrodeposition of Alloys, Principles and Practice*, by Abner Brenner, vol. II, 1963 (pp. 378 and 382), no month available.

*Primary Examiner*—Kishor Mayekar

*Attorney, Agent, or Firm*—Harness, Dickey & Pierce, P.L.C.

[57] ABSTRACT

A tungsten alloy electroplating bath. Highly ductile tungsten alloy deposits are facilitated using a sulfur co-depositing ductility additive such as:

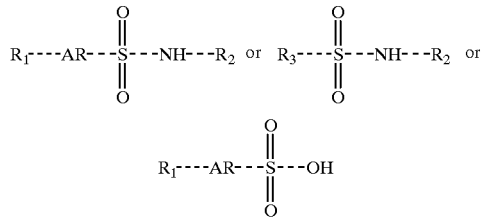

wherein $R_1$ is selected from the group consisting of $H_1$, alkyl, alkenyl, hydroxy, halogen, carboxy and carbonyl;

"AR" designates a benzene or naphthalene moiety;

$R_2$ is selected from the group consisting of H, or an alkyl sulfonic acid, a Group I or Group II salt of an alkyl sulfonic acid, a benzene, a sulfonate, a naphthalene sulfonate, a benzene sulfonamide, a naphthalene sulfonamide, an ethylene alkoxy, a propylene alkoxy; and $R_2$ may be attached to "AR" to form a cyclic moiety; and $R_3$ is selected from the group consisting of a benzene, a naphthalene, an unsaturated aliphatic group; and a benzenesulfonate group.

The additive provides ductility improvements in tungsten alloy electroplates deposited from the solution.

20 Claims, No Drawings

DUCTILITY AGENTS FOR NICKEL-TUNGSTEN ALLOYS

BACKGROUND OF THE INVENTION

The present invention relates to a ductility additive for use in tungsten alloy electroplating baths which provides tungsten alloy electroplates for use in replacing hexavalent chromium plating or other hard lubrous coatings.

Chromium plating for decorative and functional plating purposes has always been desirable. Most often chromium plating is carried out in hexavalent chromium electrolytes. Functional coatings from hexavalent chromium baths generally range in thickness from about 0.0002" to about 0.200" and provide very hard, lubrous corrosion resistant coatings. Decorative coatings from hexavalent chromium electrolytes are much thinner, typically 0.000005" to 0.000030", and are desirable because of their blue-white color, and abrasion and tarnish resistance. These coatings are almost always plated over decorative nickel or cobalt, or nickel alloys containing cobalt or iron.

The imposition of government restrictions on the discharge of toxic effluent, including hexavalent chromium present in conventional chromium plating baths, has escalated in recent years. Some state and local government restrictions are extremely stringent. This is especially the case with regard to fumes generated during the electrolysis of hexavalent chromium baths. In some locales, even minuscule amounts of airborne chromium is unacceptable. This has prompted the development of alternative electroplating baths intended to approach the color and the characteristics of chromium deposits.

One possible solution is the electrodeposition of tungsten alloys. Typically, in such baths, salts of nickel, cobalt, iron or mixtures thereof are used in combination with tungsten salts to produce tungsten alloy deposits on various conductive substrates. In this case, the nickel, cobalt and/or iron ions act to catalyze the deposition of tungsten, such that alloys containing as much as 50% tungsten can be deposited; said deposits having excellent abrasion resistance, hardness, lubricity and acceptable color when compared to chromium.

However, while such deposits have been desirable as replacements for chromium, the properties of resulting deposits and inherent manufacturing limitations in prior art processes have not allowed such deposits to replace decorative or functional chromium deposits. While alkaline complexed nickel-tungsten co-deposits have been known, the deposits produced from these electrolytes often are generally low in ductility and, therefore, are subject to stress cracking and the like. Thus, use of tungsten electroplates has been limited to thin deposits or deposits where cracks are allowed.

Commonly assigned prior U.S. Pat. No. 5,525,206 to Wieczerniak addresses brightening agents for improving surface and appearance qualities. However, there remains a need in the art to provide tungsten alloy electroplates with improved physical properties of ductility.

SUMMARY OF THE INVENTION

In accordance with the aforementioned goals, there is provided in accordance with the present invention an electrolyte for electroplating of a ductile tungsten alloy.

The electrolyte bath of the present invention includes an effective amount of tungsten ions, and also an effective amount of a metal ion or mixtures of metal ions which are compatible with the tungsten ions for electroplating of a tungsten alloy from the electrolyte. The electrolyte also includes one or more complexing agents to facilitate the electroplating of the tungsten alloy electroplate. It is critical in the present invention to provide an effective amount of a bath soluble ductility enhancer additive.

Tungsten alloy electroplates, when plated in accordance with the present invention, provide ductile tungsten electroplates.

Further benefits and advantages of the present invention will be readily realized by those skilled in the art upon review of the description of the preferred embodiments, examples and claims set forth below.

DETAILED DESCRIPTION OF THE PREFERRED EMBODIMENTS

In accordance with the broad aspects of the present invention, an electrolyte bath for electroplating of a brightened tungsten alloy is provided. The electrolyte includes an effective amount of tungsten ions and metal ions, which are compatible with tungsten, for electroplating an alloy with tungsten from the electrolyte. One or more complexing agents are provided in the electrolyte for facilitating the plating of the tungsten alloy from the electrolyte. As a critical component of the present invention, an effective amount of a sulfur co-depositing ductility-enhancing additive is present.

Typically, an electrolyte, in accordance with the present invention, includes from about 4 g/l (grams per liter) to about 100 g/l tungsten ions in the electrolyte, and preferably from about 25 g/l to about 60 g/l tungsten ions. Tungsten ions are provided in the bath, as is known to those skilled in the art, in the form of salts of tungsten such as sodium tungstate or the like.

Metals which are compatible for plating with tungsten for forming tungsten-metal alloy electroplates include iron, cobalt, and nickel, with nickel being a preferred constituent in the present invention. These metal constituents require solubility in the electrolyte and, therefore, sulfates or carbonate salts of the selected metal are typically utilized. Generally, ranges of from about 0.20 g/l to about 40 g/l of the alloying metal ion are used in the subject invention. However, preferred ranges for nickel ion concentration in the electrolyte are from about 3 g/l to about 7 g/l of the nickel ion. The nickel, iron, cobalt or other bath constituent is necessary in the tungsten plating electrolytes in that it acts as a catalyst which enables the tungsten to plate from the solution.

Complexing agents useful in the present invention include those commonly used in other electroplating electrolytes, such as citrates, gluconates, tartrates and other alkyl hydroxy carboxylic acids. Generally, these complexing agents are used in amounts of from about 10 g/l to about 150 g/l, with preferred amounts in the present bath being from about 45 g/l to about 90 g/l. In a preferred electrolyte of the present invention, a source of ammonium ions is provided in addition to one or more of the above complexing agents. The source of ammonium ions stimulates plating of tungsten from the bath and helps keep the metals in solution during plating. Preferred quantities of ammonium ions in the baths of present invention include from about 5 g/l to about 20 g/l ammonium ions. The ammonium ions may be provided in different forms, with ammonium hydroxide being a preferred agent. Of course, ammonium ions may also be provided in a compound such as nickel ammonium citrate when used in the present electrolyte.

For effective electroplating, electrolytes of the present invention are maintained at a pH of from about 6 to about 9, with typical ranges of pH being from about 6.5 to about 8.5. The electrolyte of the present invention is useful at temperatures of from about 20° C. to about 90° C., with preferred operating temperatures of the present electrolyte being from about 40° C. to about 70° C.

As stated above, it is critical in the present invention to include a sulfur co-depositing ductility additive in the bath. Sulfur co-depositing additives include sulfonamides, sulfonimides, sulfonic acids, sulfonates and the like. For use in nickel-tungsten co-deposits which include relatively high amounts of tungsten (greater than 30%), sulfonimides, sulfonamides and sulfonic acids are preferred. Such sulfonimides may be cyclic.

Sulfo salicylic acids are preferred when tungsten content in the alloy is not critical.

Preferably, bath soluble sulfonic acids and their derivatives are used as ductility agents with particularly preferred agents being aromatic sulfonic acids.

A particularly preferred sulfur co-depositing ductility additive for most nickel-tungsten alloys has the formula:

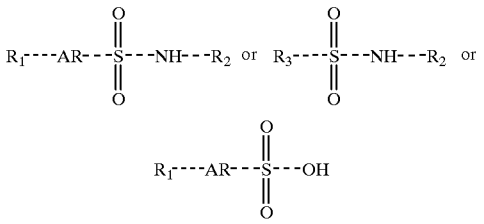

wherein $R_1$ is selected from the group consisting of H, alkyl, alkenyl, hydroxy, halogen, carboxy and carbonyl;

"AR" designates a benzene or naphthalene moiety;

$R_2$ is selected from the group consisting of H, or an alkyl sulfonic acid, a Group I or Group II salt of an alkyl sulfonic acid, a benzene, a sulfonate, a naphthalene sulfonate, a benzene sulfonamide, a naphthalene sulfonamide, an ethylene alkoxy, a propylene alkoxy; and $R_2$ may be attached to "AR" to form a cyclic moiety; and $R_3$ is selected from the group consisting of a benzene, a naphthalene, an unsaturated aliphatic group; and a benzenesulfonate group.

The additive provides ductility improvements in tungsten alloy electroplates deposited from the solution.

Preferred additives for use in the present invention include benzene sulfonamide, bisbenzene sulfonamide, sodium saccharin, sulfur salicylic acid, benzene sulfonic acid, salts of these and mixtures thereof.

Preferably, the ductility of the present invention is a benzene sulfonamide which is used in amounts of from about 0.1 mg/l to about 20 g/l. Typically, the additive is used in amounts from about 100 mg to about 5 g/l, and preferably from about 0.5 g/l to about 3 g/l, depending on the thickness of the resulting plate.

With the additives of the present invention, ductile tungsten alloy deposits can be accomplished with current densities of generally from about 1 amp per square foot (ASF) to about 125 ASF, with preferred operating currents for electroplating current of from about 60 ASF to about 80 ASF.

The additives in accordance with the present invention are compatible with common nickel-tungsten baths and brightening additives such as those set forth in U.S. Pat. No. 5,525,206 to Wieczerniak, et al.

Deposits of the present invention may be used as a suitable replacement for chrome plates without the requirement of machining steps. Deposits of the present invention are particularly useful for functional applications such as platings on shafts of shock absorbers, engine valves, transmission parts, hydraulic cylinder surfaces, and a plethora of other applications commonly utilizing chromium electroplates.

Further understanding of the present invention will be had by reference to the following examples, which are presented herein for purposes of illustration but not limitation.

EXAMPLE I

An aqueous (1 liter) electroplating bath is prepared in accordance with Table 1 set forth below:

TABLE 1

| Bath Constituent | Amount |
|---|---|
| nickel metal* | 5 g/l |
| tungsten metal** | 28 g/l |
| ammonia | 10 g/l |
| bisbenzene sulfonamide | 0.9 g/l |
| citric acid | 70 g/l |

*from nickel sulfate
**from sodium tungstate

The bath was adjusted to and maintained at a pH of from about 7 to about 8, and was maintained at a temperature of 50° C. A series of steel cathodes were plated with current densities ranging from 1 ASF to 80 ASF. Deposits plated from this bath demonstrated commercially acceptable electroplates in current density ranges of from 1 ASF to 80 ASF with high ductility. Tungsten content in the resulting deposit is 38% by weight.

EXAMPLE II

An aqueous (1 liter) electroplating bath is prepared in accordance with Table 2 below.

TABLE 2

| Bath Constituent | Amount |
|---|---|
| nickel metal* | 8 g/l |
| tungsten metal** | 30 g/l |
| ammonia | 12 g/l |
| benzene sulfonamide | 1.6 g/l |
| citric acid | 72 g/l |

*from nickel sulfate
**from sodium tungstate

A deposit was electroplated from the solution onto a steel cathode at a current density of 60 ASF. The deposit plated from this solution gave an excellent ductile nickel-tungsten deposit at 60 ASF. The deposit had a tungsten content of 35% by weight.

EXAMPLE III

Utilizing the bath chemistry of Example 1, the bisbenzene sulfonamide additive is replaced with each of the various additives (A) shown in Table 3. The amount of each additive (A) used in each bath is shown in Table 3 below. Sample electroplates are thereafter tested for % by weight of nickel, tungsten and sulfur in the resultant electroplate alloy. The results are also set forth in Table 3 below. The deposits are ductile with no stress cracking.

TABLE 3

| Additive Amount in Solution | Additive (A) | Electroplate Alloy Analysis (percent) % Ni | % W | % S |
|---|---|---|---|---|
| 1.4 g/l | sodium saccharin | 63.73944 | 36.17021 | 0.090351 |
| 1% by volume | sulfo salicylic acid | 84.6203 | 15.04083 | 0.338876 |
| 2 g/l | benzene sulfonic acid sodium salt | 64.07172 | 35.77733 | 0.150948 |
| 1.6 g/l | benzene sulfonamide | 60.86492 | 39.0494 | 0.085683 |
| 0.9 g/l | bisbenzene sulfonamide | 66.23565 | 33.63783 | 0.126527 |

While the above specification and exemplifications were given for purposes of disclosing the preferred embodiment of the present invention, it is not to be construed to be limiting of the present invention.

It will be readily appreciated by those skilled in the art that the present invention can be practiced other than as specifically stated. Thus, the invention may be subject to modification, variation and change without departing from the proper scope and fair meaning of the accompanying claims.

What is claimed is:

1. An aqueous electrolyte bath, for electroplating a brightened tungsten alloy, comprising:

an effective amount of tungsten ions for providing alloys containing from about 15–50% by weight tungsten in the final electroplated alloy;

an effective amount of metal ions compatible with electroplating an alloy with tungsten from the electrolyte bath;

one or more complexing agents selected from the group consisting of carboxylic acids and ammonium ions; and an effective amount of a bath soluble ductility additive capable of co-depositing sulfur in a brightened tungsten alloy electroplate thereby imparting a highly ductile final tungsten alloy deposit, wherein the bath has a pH of from about 6 to about 9.

2. The bath of claim 1 wherein the ductility additive has the formula:

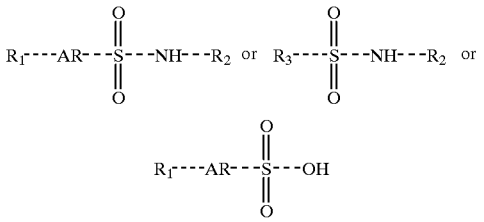

wherein $R_1$ is selected from the group consisting of H, alkyl, alkenyl, hydroxy, halogen, carboxy and carbonyl;

"AR" designates a benzene or naphthalene moiety;

$R_2$ is selected from the group consisting of H, an alkyl sulfonic acid or a Group I or Group II salt of an alkyl sulfonic acid, a benzene, a sulfonate, a naphthalene sulfonate, a benzene sulfonamide, a naphthalene sulfonamide, an ethylene alkoxy, and a propylene alkoxy; and $R_2$ may be attached to "AR" to form a cyclic moiety; and $R_3$ is selected from the group consisting of a benzene, a naphthalene, an unsaturated aliphatic group, and a benzenesulfonate group.

3. The bath of claim 1 wherein the bath soluble ductility additive is selected from the group consisting of: benzene sulfonamide, bisbenzene sulfonamide, sodium saccharin, sulfo salicylic acid, benzene sulfonic acid, salts of these additives and mixtures thereof.

4. The bath of claim 3 wherein the additive is benzene sulfonamide.

5. The bath of claim 4 wherein the benzene sulfonamide is used in amounts of from about 0.5 g/l to about 3 g/l.

6. The bath of claim 1 wherein the additive is used in amounts of from about 0.1 mg/l to about 20 g/l.

7. The bath of claim 1 wherein the additive is used in amounts of from about 100 mg/l to about 5 g/l.

8. The bath of claim 1 wherein the additive is used in amounts of from about 0.5 g/l to about 3 g/l.

9. The bath of claim 1 wherein the bath comprises from about 4 g/l to about 100 g/l tungsten ions and from about 0.20 g/l to about 40 g/l nickel ions as the alloying metal ions.

10. The bath of claim 1 wherein the bath includes from about 25 g/l to about 60 g/l tungsten ions and from about 3 g/l to about 7 g/l nickel ions as the alloying metal ions.

11. A method for depositing a ductile brightened tungsten alloy comprising:

(a) providing an electroplating bath having a pH from about 6–9, including an effective amount of nickel and tungsten ions for electroplating of a nickel-tungsten alloy from the bath containing from about 15–50% tungsten in said alloy, an effective amount of one or more complexing agents and an effective amount of a bath soluble ductility additive capable of co-depositing sulfur in a brightened tungsten alloy electroplate, thereby providing a ductile bright tungsten alloy deposit;

(b) providing an anode and a cathode in said bath; and (c) providing an effective amount of current to said anode and cathode for depositing a ductile nickel-tungsten deposit on said cathode.

12. The method of claim 11 wherein the ductility additive has the formula:

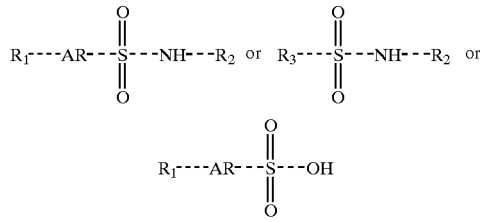

wherein $R_1$ is selected from the group consisting of H, alkyl, alkenyl, hydroxy, halogen, carboxy and carbonyl;

"AR" designates a benzene or naphthalene moiety;

$R_2$ is selected from the group consisting of H, an alkyl sulfonic acid or a Group I or Group II salt of an alkyl sulfonic acid, a benzene, a sulfonate, a naphthalene sulfonate, a benzene sulfonamide, a naphthalene sulfonamide, an ethylene alkoxy, and a propylene alkoxy; and $R_1$ may be attached to "AR" to form a cyclic moiety; and $R_3$ is selected from the group consisting of a benzene, a naphthalene, an unsaturated aliphatic group, and a benzenesulfonate group.

13. The method of claim 11 wherein the bath soluble ductility additive is selected from the group consisting of: benzene sulfonamide, bisbenzene sulfonamide, sodium saccharin, sulfo salicylic acid, benzene sulfonic acid, salts of these additives and mixtures thereof.

14. The method of claim 13 wherein the additive is benzene sulfonamide.

15. The method of claim 14 wherein the benzene sulfonamide is used in amounts of from about 0.5 g/l to about 3 g/l.

16. The method of claim 11 wherein the additive is used in amounts of from about 0.1 mg/l to about 20 g/l.

17. The method of claim 11 wherein the additive is used in amounts of from about 100 mg/l to about 5 g/l.

18. The method of claim 11 wherein the additive is used in amounts of from about 0.5 g/l to about 3 g/l.

19. The method of claim 11 wherein the bath comprises from about 4 to about 100 tungsten ions and from about 0.20 g/l to about 40 g/l nickel ions.

20. The method of claim 11 wherein the bath includes from about 25 g/l to about 60 g/l tungsten ions and from about 3 g/l to about 7 g/l nickel ions.

* * * * *

UNITED STATES PATENT AND TRADEMARK OFFICE

CERTIFICATE OF CORRECTION

PATENT NO. : 6,045,682

DATED : April 4, 2000

INVENTOR(S) : Danielle Rodriguez

It is certified that error appears in the above-identified patent and that said Letters Patent is hereby corrected as shown below:

Title Page, [57] ABSTRACT, Line 15, "$H_1$," should be --H--.

Column 6, Line 63, "$R_1$" should be --$R_2$--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*